US005878436A

United States Patent [19]

Jones

[11] Patent Number: 5,878,436

[45] Date of Patent: Mar. 9, 1999

[54] CENTER WEBBED BASEBALL MITT

[76] Inventor: Robert B. Jones, 928 Wyoming St., Allentown, Pa. 18103-3994

[21] Appl. No.: 901,049

[22] Filed: Jul. 25, 1997

[51] Int. Cl.[6] ..... A41D 13/08

[52] U.S. Cl. ..... 2/19

[58] Field of Search ..... 2/19, 16, 161.1; D2/361

[56] References Cited

U.S. PATENT DOCUMENTS

| | | | |
|---|---|---|---|
| 906,278 | 12/1908 | Peterson | 8/19 |
| 980,679 | 1/1911 | Rogers | 2/19 |
| 1,045,231 | 11/1912 | Whitley | 2/19 |
| 2,113,934 | 4/1938 | Denkert | 2/19 |
| 4,665,561 | 5/1987 | Aoki | 2/19 |
| 4,996,721 | 3/1991 | Beshro | 2/19 |
| 5,253,365 | 10/1993 | Clevenhagen | 2/19 |
| 5,402,537 | 4/1995 | Kolanda | 2/19 |
| 5,544,362 | 8/1996 | Synek | 2/19 |

*Primary Examiner*—William Stryjewski
*Assistant Examiner*—Larry D. Worrell, Jr.
*Attorney, Agent, or Firm*—Sanford J. Piltch

[57] ABSTRACT

A center webbed baseball glove which utilizes the natural fold of the human hand and folds into two equal halves increasing the utilizable surface area is provided. The center webbed glove is constructed from a pocket and back piece which are attached together to form a central pocket, a set of outer finger slots and a set of inner finger slots. The glove is worn by placing the pinky and ring fingers into the left outer finger slot, the middle and index fingers into the left inner finger slot, and the thumb into either the outer or inner right finger slots. The glove can be worn on the right hand by placing the thumb in the left inner or outer finger slots and placing the remaining fingers in the left finger slots of the glove.

6 Claims, 4 Drawing Sheets

CENTER WEBBED BASEBALL MITT

BACKGROUND OF THE INVENTION

The present invention relates to baseball or softball gloves. In particular, the present invention relates to a center webbed baseball glove which enhances a player's ability to catch a baseball by utilizing the natural fold of the player's hand and by increasing the exploitable surface area of the glove.

Whether a beginner or a professional, catching a baseball or softball is an essential skill which must be learned. Learning to catch a ball is especially difficult for younger players because they have limited coordination and strength. This problem is further complicated by existing baseball glove designs. There are few, if any baseball gloves which are designed to aid younger players. For example, most children and adults have relatively weak thumb strength. Existing glove designs, however, are configured so that a player must bring his or her thumb across the palm of the hand in order to close the glove. An added consequence of this is that only one third of the glove closes onto itself thus providing a small percentage of the total surface area of the glove for catching a ball. Thus, existing gloves rely purely on thumb strength and provide small surface area for catching a ball. A younger player would be better served if he or she could use the full gripping motion which would close the ring, pinky, middle and index fingers across the palm and could rely on the entire surface area of the glove for catching a ball.

One solution for lessening the strength required for a player to catch a baseball or softball is to simply shrink the size of the glove to better fit the player's hand. A smaller glove requires less effort to close and is more manageable, however, the smaller surface area requires greater hand to eye coordination because the player must be more precise when aligning the ball with the web and pocket of the glove.

Another solution is suggested in U.S. Pat. No. 4,365,352 [Ziedele] which discloses an enlarged glove with a symmetrical design. Ziedele fails, however, to realize any benefit from the symmetrical design because the glove utilizes a center finger slot surrounded by dual webbing. This finger positioning within Ziedele requires bringing the thumb across the wrist relying purely upon thumb strength to close the glove. Moreover, this finger positioning causes Ziedele to fold unevenly, thus under utilizing the surface area of the glove.

Therefore, it is desired that a baseball glove be provided which utilizes the natural fold of the human hand and increases the surface area of the glove which is used to catch a baseball.

Accordingly, it is an object of the present invention to provide a baseball glove which allows a player to catch a ball by squeezing the pinky, ring, middle and index fingers across the palm of the hand.

It is a further object of the present invention to provide a baseball glove which features a center web and central pocket.

It is a further object of the present invention to provide a baseball glove which is symmetrical and folds in half across a vertical centerline.

It is a further object of the present invention to provide a baseball glove which prevents a ball from directly impacting with the palm of the hand.

Still further, it is an object of the present invention to provide a baseball glove which can be worn by a left or right handed player.

Other objects, advantages and novel features of the present invention will become apparent from the following detailed description of the invention when considered in conjunction with the accompanying drawings.

SUMMARY OF THE INVENTION

The present invention features a center webbed baseball glove constructed from symmetrically congruent pocket and back pieces. The pocket and back pieces are cut in the shape of a four fingered glove having a set of outer and inner finger cut outs. The pocket and back pieces are sewn and woven together to form left and right outer finger slots and left and right inner finger slots. The outer and inner finger slots are attached together at their distal ends by a single weave, but are otherwise free to move independently of each other. Located at the proximal end of the outer and inner finger slots are adjustable finger holds which tighten to customize the fit of the glove.

A centrally located web constructed from flexible material is located between and attached to the inner finger stalls. The web folds in half along a vertical centerline which divides the web and the glove into two equal halves. Located immediately below the web is a central pocket which also folds in half along the vertical centerline. The central pocket is surrounded by pocket lacing which is woven along the outside of the outer finger stalls. The pocket lacing provides an added gripping surface which prevents the ball from slipping out of the glove once it is closed.

The glove is worn by placing the ring and pinky fingers in the outer finger stall and the middle and index fingers in the inner finger stall. The thumb is then placed in the outer finger stall opposite the finger stall in which the pinky and ring fingers were placed. This configuration allows the glove to be closed by bringing the fingers over the palm of the hand. In addition, this configuration will close the glove into two equal halves fully utilizing the surface area of the glove.

BRIEF DESCRIPTION OF THE DRAWINGS

For the purpose of illustrating the invention, there is shown in the drawings an embodiment of the invention which is presently preferred; it being understood, however, that this invention is not limited to precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
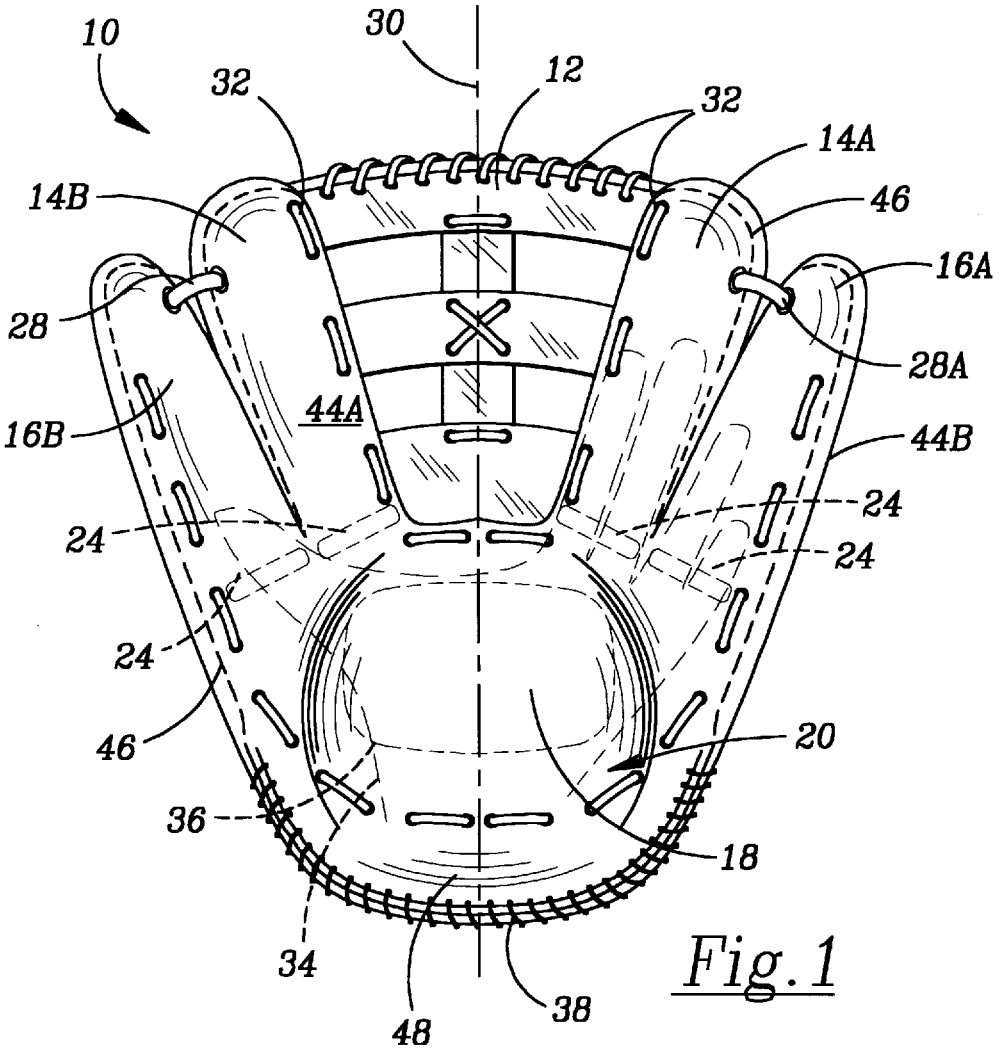
FIG. 1 is a front view of the center webbed baseball glove also illustrating the hand placement within the glove when it is open.

Referring now to the drawings wherein the same reference numbers indicate the same elements, there is shown in FIG. 1 the center webbed baseball glove 10 of the present invention. The center webbed glove 10 is constructed from symmetrical pocket piece 44A and back piece 44B. The pocket piece 44A and back piece 44B both have roughly the same shape and are cut from a durable, semi-flexible sheet material such as leather. The pocket piece 44A and back piece 44B are cut in the shape of a four fingered glove having a gap between the middle fingers. The back piece 44B has an additional cutout for forming the optional finger slot 22. The pocket and back pieces 44A, 44B are sewn and woven together along their outer edges by nylon stitching 46 and leather heel weaving 38 to form glove 10.

Figure 2:
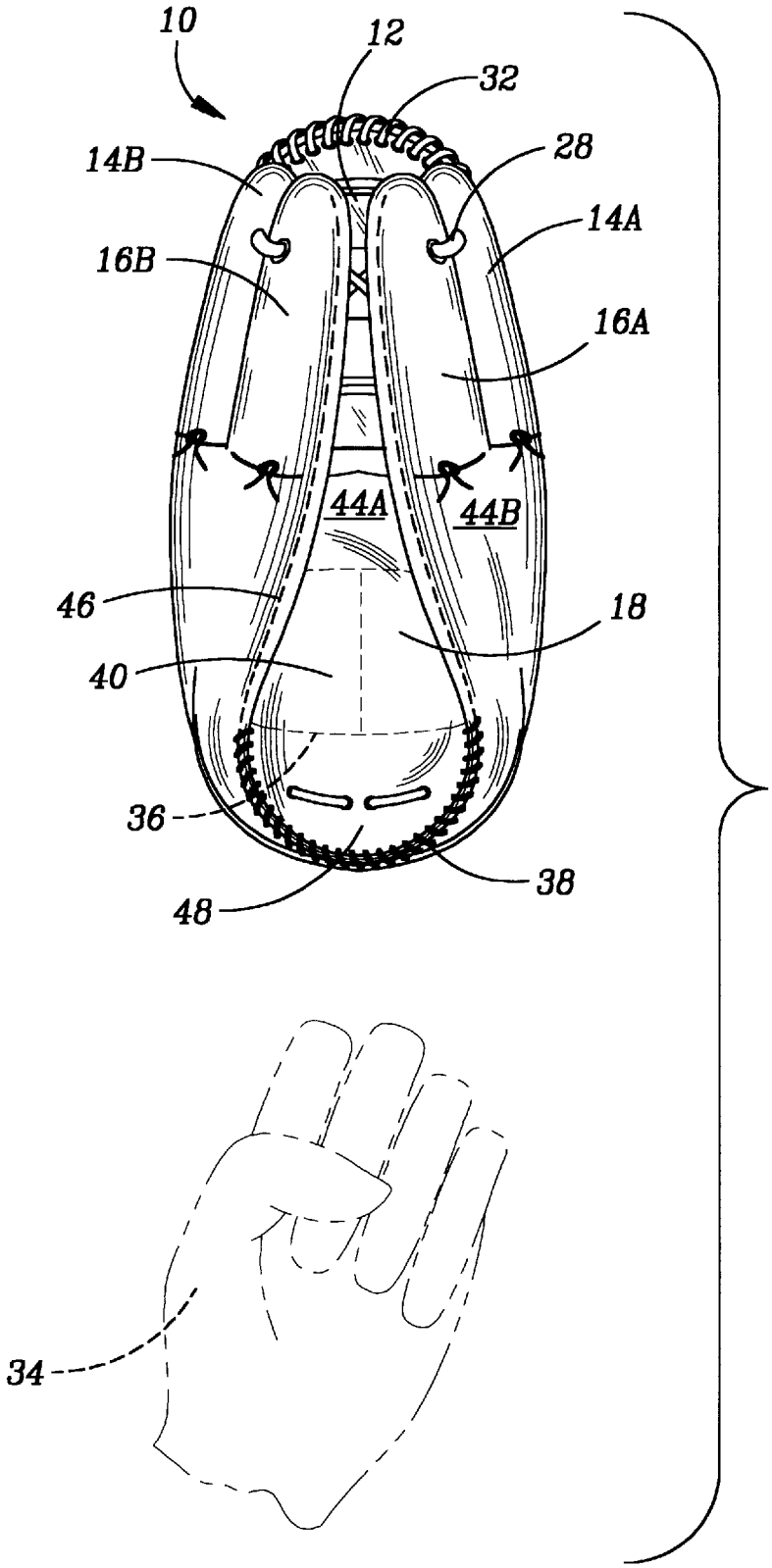
FIG. 2 is a front view of the center webbed baseball glove also illustrating the hand motion which will close the glove.
Figure 3:
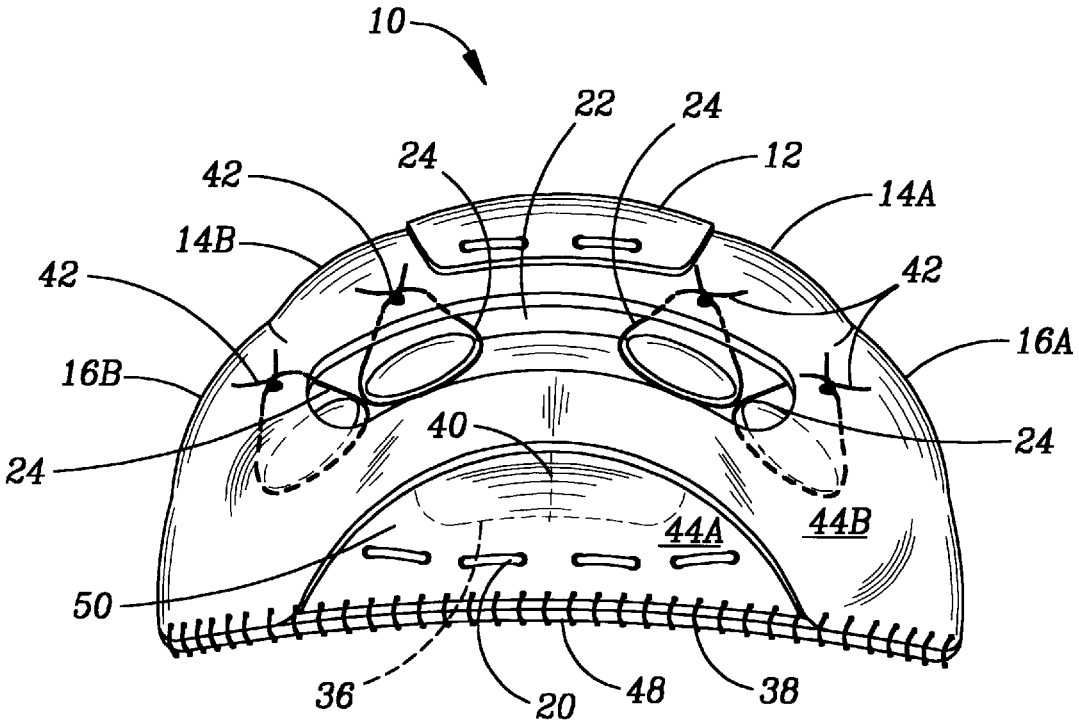
FIG. 3 is a bottom view of the center webbed baseball glove showing the finger slots and holds.

As shown in FIGS. 2 and 3, the heel 48 and palm slot 50 are formed by weaving the outside of the heel portions of pocket piece 44A and back piece 44B together using heel weaving 38. Heel weaving 38 extends only throughout pocket piece 44A and does not connect the central region of the heel portions of pocket piece 44A and back piece 44B. Thus, palm slot 50 is formed between back piece 44B and pocket piece 44A. Heel weaving 38 provides palm slot 50 with a degree of expandability by allowing back piece 44B and front piece 44A to slightly separate. Thus, palm slot 50 will conform to the palm of the player, and glove 10 can be more easily removed from the players hand.

The finger slots 14A, 14B, 16A, 16B are formed by sewing the outside of the corresponding fingers of pocket piece 44A and back piece 44B together using nylon stitching 46. A web 12 is woven between and to inner finger slots 14A and 14B by web weaving 32 which extends along the bottom and top of web 12 and along the inside of inner finger slots 14A and 14B. Web 12 can be any conventional design, but must be symmetrical and able to fold in equal halves. As shown in FIG. 1, web 12 is a three piece triple locking web which is commonly used in an infielder's glove.

The outer finger slots 16A, 16B are attached to the inner finger slots 14A, 14B at their distal ends by leather weave 28, but are otherwise free to move independently of inner finger slots 14A, 14B. The primary reason for attaching the outer 16A, 16B and inner 14A, 14B finger slots together is to provide greater control of the glove 10 when catching a ball. If the player prefers, weave 28 can be omitted and the outer 16A, 16B and inner 14A, 14B finger slots will be free to move completely independent of each other.

Adjustable finger holds 24 are placed inside finger slots 14A, 14B, 16A, 16B at their proximal ends. Finger holds 24 provide the player with greater control of the glove when catching a ball by directly linking the fingers with the glove 10. As can be seen in FIG. 3, the size of finger holds 24 can be customized to the individual player's finger size by pulling leather tie straps 42 which are located at the proximal end of finger holds 24 and protrude through back piece 44B. Once the finger holds 24 are adjusted for size, the straps 42 are tied off.

Located below web 12 is central pocket 18 which is surrounded by pocket weaving 20. Often, a player will either close glove 10 too early or too hard thus forcing the ball out of the glove 10. pocket weaving 20 serves as a gripping surface which prevents balls from slipping out of the central pocket 18 during these situations. For example, if the player closes glove 10 too early, pocket weaving 20 serves as a frictional surface which will dig into the ball and grip it. Central pocket 18 also includes palm pad 36 which is sewn into pocket piece 44A inside the palm slot 50. Palm pad 36 is symmetrical and is positioned so that its center is aligned with the center of central pocket 18. Palm pad 36 is hinged by stitching 40 which allows palm pad 36 to fold in half. Often, a hard thrown ball can leave a player's hand with a stinging sensation or, even worse, can bruise the players hand. The palm pad 36 is constructed from a protective material which will protect the players hand from the impact of the ball.

Figure 4:
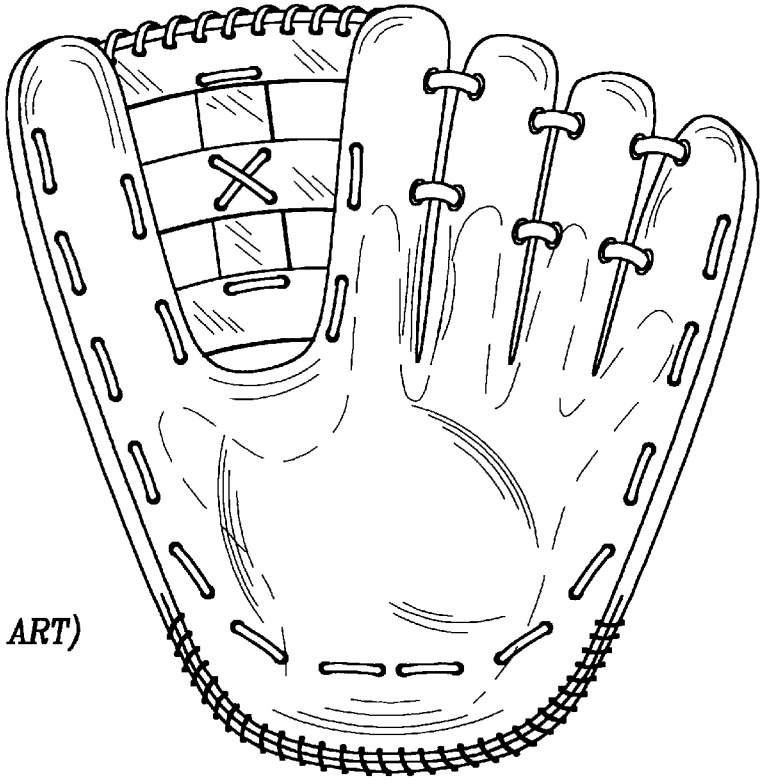
Fig.4 (PRIOR ART)
FIG. 4 is a front view of a conventional baseball glove also illustrating the hand position within the glove when it is in an open position.
Figure 5:
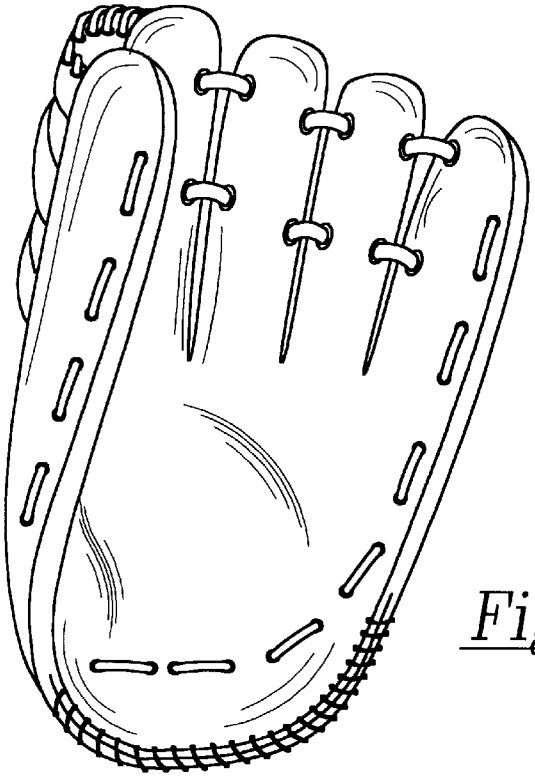
Fig.5 (PRIOR ART)
FIG. 5 is a front view of a conventional baseball glove also illustrating the hand motion which will close the glove.

The symmetrical design of glove 10 insures that the entire surface area of the glove 10 is available to catch a ball. As shown in FIGS. 4 and 5 the finger positioning within a conventional glove folds a third of the glove onto itself and does not utilize the entire pocket. In contrast, FIG. 2 illustrates that the glove 10 of the present invention closes to surround the central pocket 18. Once closed, the pocket weaving 20 serves to lock the ball within the central pocket 18. In addition, web 12 is able to operate in conjunction with pocket 18 allowing the player to catch and retain the ball within web 12 or pocket 18 whereas in conventional designs the pocket funnels the ball to the web where it is retained.

In order to utilize glove 10, the player places his ring and pinky fingers in outer finger stall 16A and the middle and index fingers are inserted in the inner finger stall 14A. The thumb is then placed in either outer finger stall 16B or inner stall 14B depending upon the player's preference and hand size. Finger holds 24 are then adjusted to properly fit the player's fingers by pulling leather tie straps 24 and tying them off when the proper size is obtained.

As illustrated in FIG. 1, a left hand 34 (shown in dotted lines) is inserted into glove 10. It should be noted that glove 10 can accommodate either a right or left handed player by simply reversing the placement of the fingers within glove 10. For example, the ring and pinky fingers can be placed in outer stall 16B, the index and middle finger in inner stall 14B and the thumb in outer stall 16A or inner stall 14A. In addition, one or all of the fingers, other than the thumb, can be placed outside the finger slots by utilizing optional finger slot 22 which opens to the outside of back piece 44B.

The configuration of the fingers within glove 10 allows it to be closed in a gripping motion, i.e. bringing the fingers over the palm of the hand 34 as shown in FIG. 2. In contrast, conventional gloves close by bringing the thumb over the palm of the hand a motion which relies purely on thumb strength to close the glove. The finger placement of hand 34 in glove 10 also closes the glove 10 into two equal halves fully utilizing the surface area of the glove. Moreover, this finger configuration prevents the ball from directly impacting with the palm of the hand 34. In conventional gloves, the palm is located directly below the pocket whereas glove 10 offsets the palm and further protects the exposed areas with palm pad 36.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A center webbed baseball glove having a symmetrical construction which utilizes the natural folding action of a human hand comprising:

a central pocket foldable in equal halves along a symmetrical vertical centerline having a gripping means;

left and right outer finger slots;

left and right inner finger slots;

said outer and inner finger slots arrayed equidistantly on either side of said vertical centerline;

a web of flexible material attached between said left and right inner finger slots and located above said central pocket, said web being foldable in equal halves along said vertical centerline; and a flexible palm pad foldable along said vertical centerlines said palm pad being located behind said central pocket.

2. The center webbed baseball glove of claim 1, wherein said left inner and outer finger slots and said right inner and outer finger slots are connected to each other respectively at their distal ends and are otherwise free to move independently of each other.

3. The center webbed baseball glove of claim 1, wherein said central pocket, said left and right outer finger slots and said left and right inner finger slots are formed by joining together a symmetrical pocket piece and back piece each having a similar shape and being cut from a piece of flexible sheet material.

4. The center webbed baseball glove of claim 1, wherein said gripping means comprises pocket lacing which is woven below said central pocket extending along the outer edge of said left and right outer finger slots.

5. The center webbed baseball glove of claim 1, further comprising adjustable finger holds located inside and at the proximal end of said left and right inner and outer finger slots, said adjustable finger holds having the capability to adjust to accommodate one or more fingers which may be placed in each one of said respective finger slots.

6. The center webbed baseball glove of claim 1, wherein said flexible palm pad is stitched along said vertical centerline to allow hinging of said flexible palm pad.

* * * * *